US007052323B1

(12) United States Patent
Ruff et al.

(10) Patent No.: US 7,052,323 B1
(45) Date of Patent: May 30, 2006

(54) CONDUCTOR TERMINATION APPARATUS AND METHOD

(75) Inventors: Brian F. Ruff, Lee's Summit, MO (US); Walter J. Rolston, Overland Park, KS (US); Greg A. January, Shawnee, KS (US)

(73) Assignee: Garmin, Ltd., George Town (KY)

( * ) Notice: Subject to any disclaimer, the term of this patent is extended or adjusted under 35 U.S.C. 154(b) by 0 days.

(21) Appl. No.: 10/285,020

(22) Filed: Oct. 30, 2002

(51) Int. Cl.
*H01R 13/66* (2006.01)

(52) U.S. Cl. ..... 439/620; 439/696

(58) Field of Classification Search ..... 439/620, 439/695, 696, 651, 913, 445, 449, 607, 608, 439/609, 610, 459, 931
See application file for complete search history.

(56) References Cited

U.S. PATENT DOCUMENTS

| | | | | |
|---|---|---|---|---|
| 3,148,928 | A * | 9/1964 | Noschese et al. | 439/472 |
| 4,130,334 | A | 12/1978 | Anderson | 339/103 |
| H379 | H | 12/1987 | Alexander, Jr. | 439/610 |
| 4,761,145 | A * | 8/1988 | Goto et al. | 439/469 |
| 4,822,286 | A * | 4/1989 | Bianca | 439/610 |
| 4,900,261 | A | 2/1990 | Gentry et al. | 439/353 |
| 4,921,441 | A | 5/1990 | Sauder | 439/460 |
| 4,973,259 | A | 11/1990 | Sachs | 439/98 |
| 5,052,947 | A | 10/1991 | Brodie et al. | 439/607 |
| 5,304,964 | A | 4/1994 | DiMarco | 333/181 |
| 5,315,063 | A | 5/1994 | Auclair | 174/78 |
| 5,372,513 | A | 12/1994 | Rodrigues et al. | 439/98 |
| 5,775,924 | A | 7/1998 | Miskin et al. | 439/98 |
| 5,820,412 | A | 10/1998 | Koegel et al. | 439/610 |
| 5,827,078 | A | 10/1998 | Simonian | 439/95 |
| 5,910,030 | A * | 6/1999 | Hollander et al. | 439/620 |
| 5,984,729 | A * | 11/1999 | Hollander et al. | 439/620 |
| 6,017,245 | A | 1/2000 | Karir | 439/610 |
| 6,354,879 | B1 * | 3/2002 | Plehaty | 439/610 |

OTHER PUBLICATIONS

Inotec Electronics Catalog—www.inotec-electronics.com, pp. 1-32 and additional miscellaneous pages from website, no date.

* cited by examiner

*Primary Examiner*—Briggitte R. Hammond
(74) *Attorney, Agent, or Firm*—Schwegman, Lundberg, Woessner & Kluth, P.A.

(57) ABSTRACT

In one embodiment, an apparatus is provided which includes a connector backshell, a conductor clamp, and a thermocouple attachment point. In another embodiment, an apparatus is provided which includes a connector backshell, a cover, a connector, a conductor clamp, and a thermocouple attachment point. A method of assembling a connector housing includes laying a plurality of unshielded conductor portions against a backshell support and clamping the plurality of unshielded conductor portions against the support. The method can also include attaching a thermocouple to a thermocouple attachment point on the backshell.

16 Claims, 3 Drawing Sheets

CONDUCTOR TERMINATION APPARATUS AND METHOD

TECHNICAL FIELD

Embodiments of the invention relate generally to apparatus and methods for terminating and connecting optical, radio frequency (RF), direct current, and other conductors. More particularly, embodiments of the invention relate to apparatus and methods for terminating conductors, including attaching connectors to optical, RF, direct current, and other conductors.

BACKGROUND

Optical, RF, and direct current conductors are often terminated using connector inserts and/or terminals. Such inserts, in turn, are assembled into connectors and provide a convenient interface to power, data, and other forms of energy communicated between various physical locations. The custom of using connectors has given rise to a large industry, and many different types of connectors, designed to accommodate particular circumstances, have become available.

Thus, even those connectors which at first glance appear to be similar can usually be differentiated by any number of user-selectable features. For example, features which can be chosen for most connectors include multiple pin/socket configurations, the use or absence of cable strain relief, and a variety of housing materials (e.g., metal and plastic). Other, more specialized features made available for some connector types include those enabling efficient assembly, such as crimp-on pins or sockets, and split-housing assemblies.

Connector pricing is competitive, and connectors which can be made in a relatively inexpensive manner, while providing a mix of general and specialized features, are valuable to both vendors and consumers. Thus, there is a need to lower up-front connector costs while increasing the number of user-selectable options. Connector features which enable rapid assembly and repair are especially desirable, since these operations affect the long-term cost of connectors.

SUMMARY

The above mentioned needs with respect to connectors will be understood by reading the following Detailed Description. The apparatus and methods of various embodiments of the invention offer convenient and flexible termination configurations to support efficient termination, repair, and replacement of conductors, including cable assemblies.

In one embodiment, an apparatus is provided which includes a backshell, a conductor clamp, and optionally, a thermocouple attachment point. In another embodiment, an apparatus is provided which includes a backshell, a cover, a connector insert, a conductor clamp, and optionally, a thermocouple attachment point. In each case, the apparatus, which may be a connector, can include a thermocouple attachment point providing a convenient mechanism to measure the temperature of the backshell and/or the surrounding environment.

Embodiments of the invention also provide an assembly method, such as a method of assembling a connector or a connector housing, which includes laying a plurality of unshielded conductor portions against a backshell support and clamping the plurality of unshielded conductor portions against the support. The method can also include attaching a thermocouple to a thermocouple attachment point on the backshell or a clamp.

These and other aspects, advantages, and features of various embodiments of the invention will be set forth in part in the Detailed Description which follows, and in part will become apparent to those skilled in the art by reference to the drawings. The aspects, advantages, and features of embodiments of the invention are also realized and attained by means of the instrumentalities, procedures, and combinations particularly pointed out in the appended claims.

DETAILED DESCRIPTION

Figure 1:
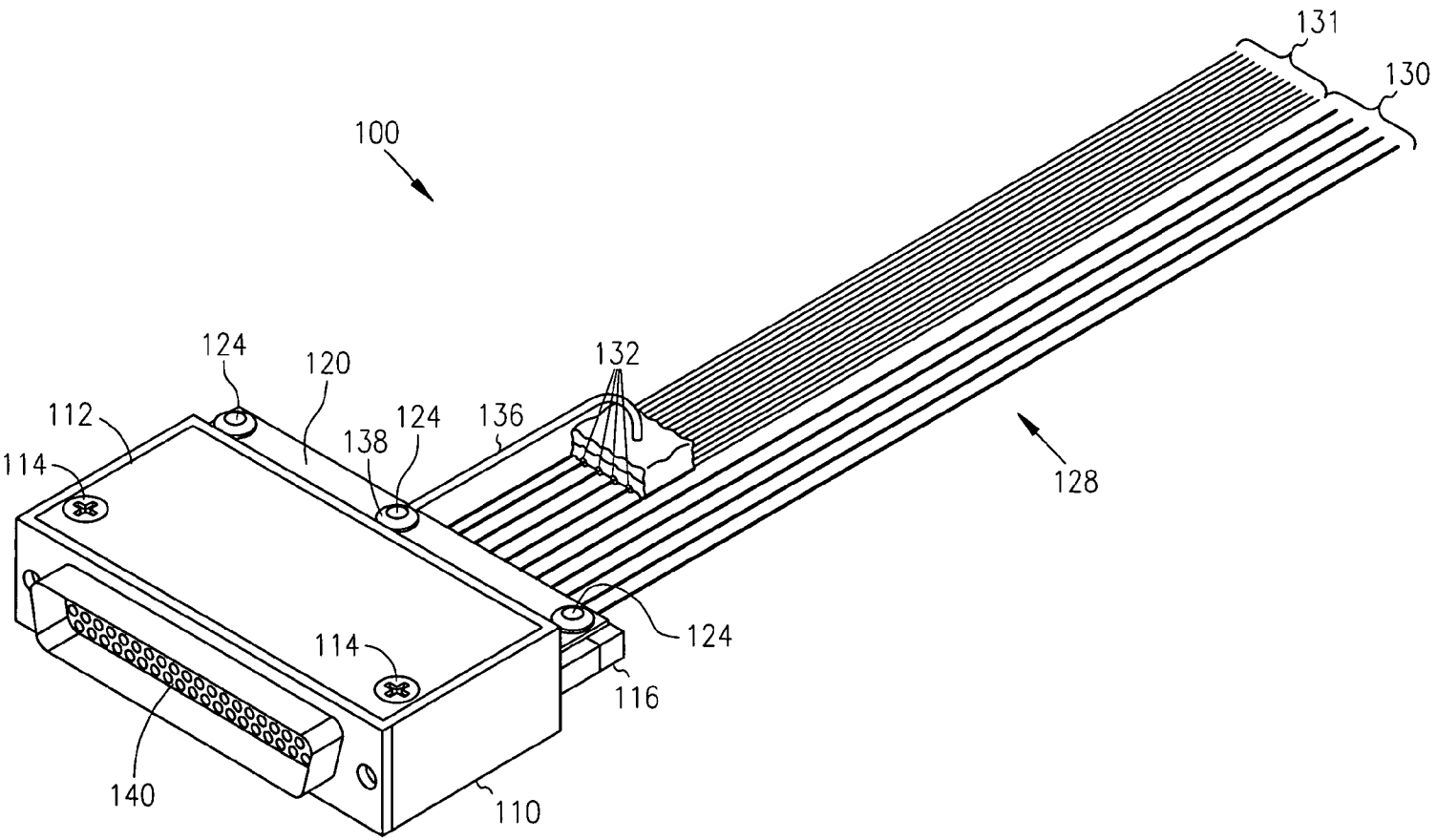
FIG. 1 is an assembled perspective view of an apparatus according to an embodiment of the invention.

In the following Detailed Description, reference is made to the accompanying drawings which form a part hereof, and in which are shown, by way of illustration, specific embodiments in which the invention can be practiced. In the drawings, like numerals describe substantially similar components throughout the several views. These embodiments are described in sufficient detail to enable those skilled in the art to practice various embodiments of the invention. Other embodiments can be utilized and structural, logical, and electrical changes can be made without departing from the scope of this disclosure.

In one embodiment, the apparatus and method of the invention are used to terminate conductors used in an aircraft, and the resulting apparatus are coupled to electronic modules mounted within the aircraft, such as those including navigation and communications equipment. Although this setting is used as an example, the apparatus and methods described herein can be used in other areas without departing from the scope of this disclosure, and embodiments of the invention are not so limited.

FIG. 1 is an assembled perspective view of an apparatus according to an embodiment of the invention. The termination apparatus 100 includes a backshell 110 and a cover 112, which can be attached to the backshell 110 using fasteners 114. The backshell 110 also includes a conductor receiving support surface 116 and a clamp 120 capable of attaching a plurality of unshielded conductor portions (not shown in FIG. 1) to the conductor receiving support surface 116. Attachment can be accomplished by compression, adhesive, or any other suitable mechanism. Removable fasteners 124, such as screws or bolts, can be used to attach the clamp 120 to the conductor receiving support surface 116. Non-removable fasteners 124, such as rivets, welding, and others can also be used.

The apparatus 100 is typically applied as a termination mechanism for a plurality of conductors 128, such as a cable or cable bundle. For example, a first portion 130 of the conductors included in the cable can be unshielded. A second portion 131 (i.e., a shielded portion), or even all of the conductors included in the plurality of conductors 128 can be shielded. The shields 132 can be grouped together and attached or bonded (e.g., using solder or some other suitable conductive medium) to a shield conductor 136, which in turn is attached or bonded to the apparatus 100. For example, the shield conductor 136, which is in electrical communication with the shielded portion 131 of the plurality of conductors 128, can be attached to the backshell 110 or to the clamp 120, perhaps using one or more of the fasteners 124 located at a shield attachment point 138. The plurality of conductors 128 can be terminated using a connector insert 140, including a D-type connector insert (similar to or identical to the type of connector insert used in a 50 way Inotec DG50M1 HD Sub D connector assembly). The apparatus 100 also includes one or more thermocouple attachment points (not shown in FIG. 1), typically located so as to be in thermal communication with an interior surface of the backshell 110.

It should be understood that other configurations of support surfaces 116 and clamps 120 are contemplated, such as using surfaces 116 and clamps 120 which are curved, instead of substantially flat, as shown in FIG. 1. Likewise, the fasteners 114, 124 shown in FIG. 1 are merely examples of many possible fastener types which can be used for compressing the clamp 120 against the support surface 116, and attaching the cover 112 to the backshell 110. Other fasteners known to those skilled in the art, both temporary and permanent, such as rivets, adhesives, screws, quarter-turn locking fasteners, bolts and nuts, etc. can also be used without departing from the scope of various embodiments of the invention.

Figure 2:
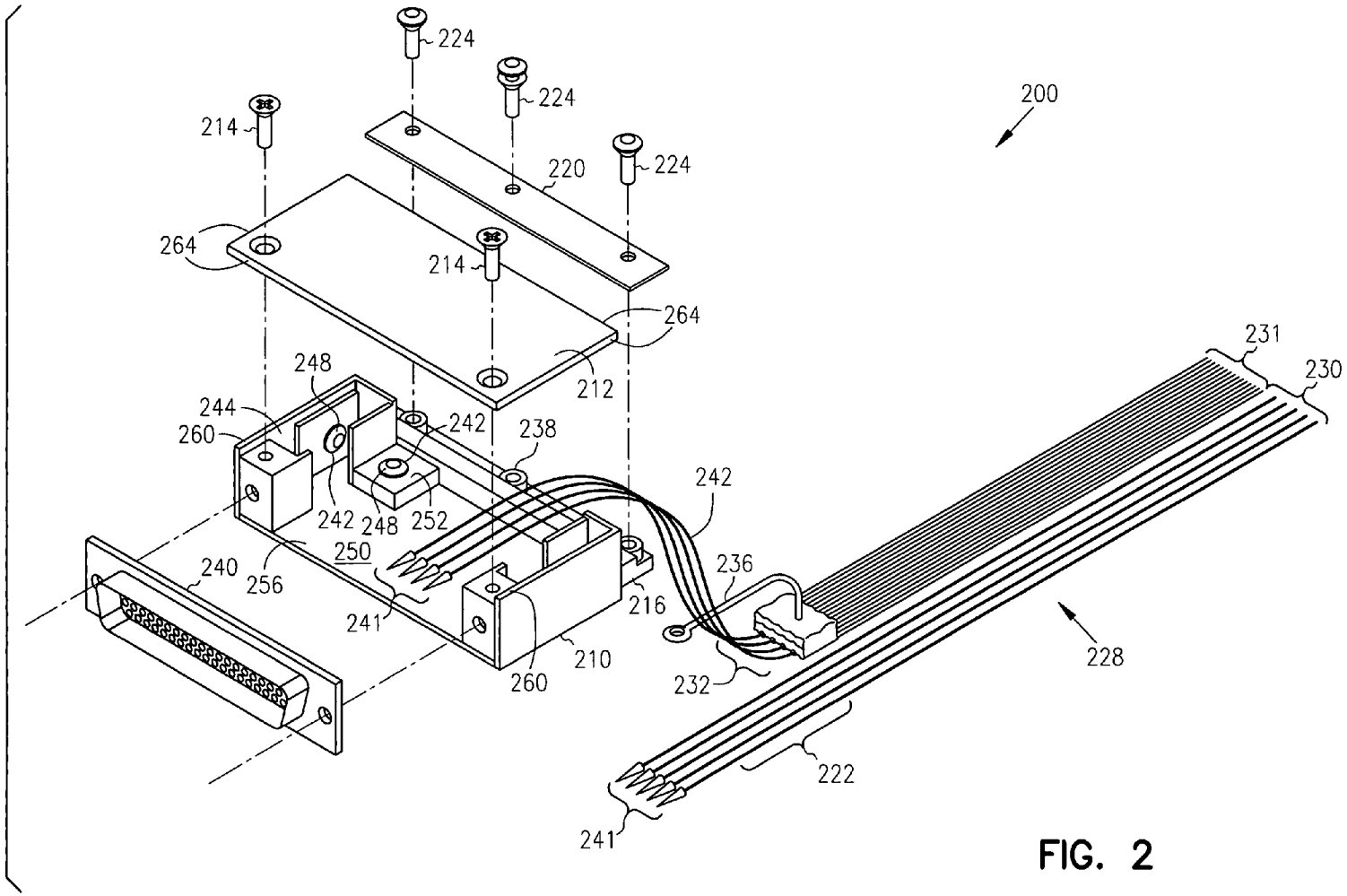
FIG. 2 is an exploded perspective view of several apparatus, according to various embodiments of the invention.

FIG. 2 is an exploded perspective view of several apparatus, according to various embodiments of the invention. In one embodiment, an apparatus 200, which can be a connector 200, includes a backshell 210, a cover 212, and fasteners 214 to attach the cover to the backshell 210.

The backshell 210 includes a conductor receiving support surface 216 and a clamp 220 capable of attaching a plurality of unshielded conductor portions 222 to the conductor receiving support surface 216, typically using compression. Fasteners 224, non-removable or removable, such as screws or bolts, can be used to attach the clamp 220 to the conductor receiving support surface 116.

As noted for the apparatus 100 in FIG. 1, the apparatus 200 is applied as a termination mechanism for a plurality of conductors 228, including a cable or a cable bundle. For example, a first portion 230 of the conductors included in the plurality of conductors 228 can be unshielded. A second portion 231 (i.e., a shielded portion 231), or even all of the conductors included in the plurality of conductors 228 can be shielded. The shields 232 can be grouped together and attached or bonded to a shield conductor 236 (e.g., using solder or some other suitable conductive medium), which in turn is attached or bonded to the apparatus 200. For example, the shield conductor 236, which is in electrical communication with the shielded portion 231 of the plurality of conductors 228, can be placed in electrical communication with the backshell 210 by attaching the shield conductor 236 to the backshell 210 or the clamp 220, perhaps using one or more of the fasteners 224 located at a shield attachment point 238. The plurality of conductors 228 can be terminated using a connector insert 240, perhaps including a number of sockets or pins 241 to which individual conductors may be soldered or crimped. The insert 240 can be removably or fixedly attached to the backshell 210.

The apparatus 200 optionally includes one or more thermocouple attachment points 242, which can be located in a recess 244, to receive one or more thermocouples 248, respectively, bonded or attached to the attachment points 242. If the attachment point 242 is located in the recess 244, the thermocouple 248 can be potted therein. Epoxies and other potting agents known to those of ordinary skill in the art may be used to attach the thermocouples 248 to the attachment points 242, whether or not a particular thermocouple 248 is located within the recess 244. In any case, thermocouples 248 are typically located so as to be in thermal communication with an interior surface 250 of the backshell 210, and attached to the attachment point 242, using screws, bolts, adhesive agents, etc.

If desired, one thermocouple 248 can be attached to a first attachment point 242 in thermal communication with the backshell 210 (e.g. a backshell thermocouple disposed proximate to an interior surface of the backshell 210), and another thermocouple 248 can be attached to a second attachment point 242 so as to be in thermal communication with the ambient environment surrounding the backshell 210 (e.g., an ambient thermocouple disposed within the recess 244). Appropriate cold junction compensation may then be applied to temperature data provided by the ambient thermocouple using temperature data provided by the backshell thermocouple. Of course, it should be noted that any type of temperature measurement devices 248 (e.g., thermistors, bimetallic elements, etc.) can be used in place of the thermocouples 248, and embodiments of the invention are not so limited.

Other features of the apparatus 200 are also apparent upon review of FIG. 2. For example, while other shapes are possible and embodiments of the invention are not so limited, the interior surface 250 of the backshell can be substantially flat. Thus, a plane 252 including the thermocouple attachment point 242 can be located so as to be substantially parallel to and elevated above a plane 256 including the substantially flat interior surface 250 of the backshell 210.

As was noted in the case of the apparatus 100 shown in FIG. 1, it should be understood that other configurations of support surfaces 216 and clamps 220 are contemplated, such as using surfaces 216 and clamps 220 which are curved, instead of substantially flat, as shown in FIG. 2. Thus, while the support surface 216 and clamp 220 can both be substantially flat, it is also possible for the clamp 220 to be substantially conformable to some other shape of the conductor receiving support surface 216. For example, the support surface 216 and clamp 220 can both be curved, variegated, or any other shape. Alternatively, the support surface 216 may be formed in a fixed shape, such as a curved shape, and the clamp 220 may be manufactured from a relatively malleable material so as to conform to the curved or variegated shape of the support surface 216 after the fasteners 224 are used to attach the clamp 220 to the support surface 216.

Likewise, the fasteners 214, 224 are merely examples of many possible fastener types which can be used for compressing the clamp 220 against the support surface 216 (so as to capture the unshielded conductor portions 222), and attaching the cover 212 to the backshell 210. Other fasteners known to those skilled in the art, both temporary and permanent, such as rivets, adhesives, screws, quarter-turn locking fasteners, bolts and nuts, etc. can also be used without departing from the scope of various embodiments of the invention.

The backshell 210 can include a lip 260 against which a portion or all of the periphery 264 of the cover 212 can be abutted or proximately disposed when the cover 212 is attached to the backshell 210. The use of a lip 260 can be important to assuring proper operation of circuitry mounted in the recess 244, with respect to containing and shielding from electromagnetic interference (EMI). Alternatively, the lip 260 can be eliminated if desired.

Figure 3:
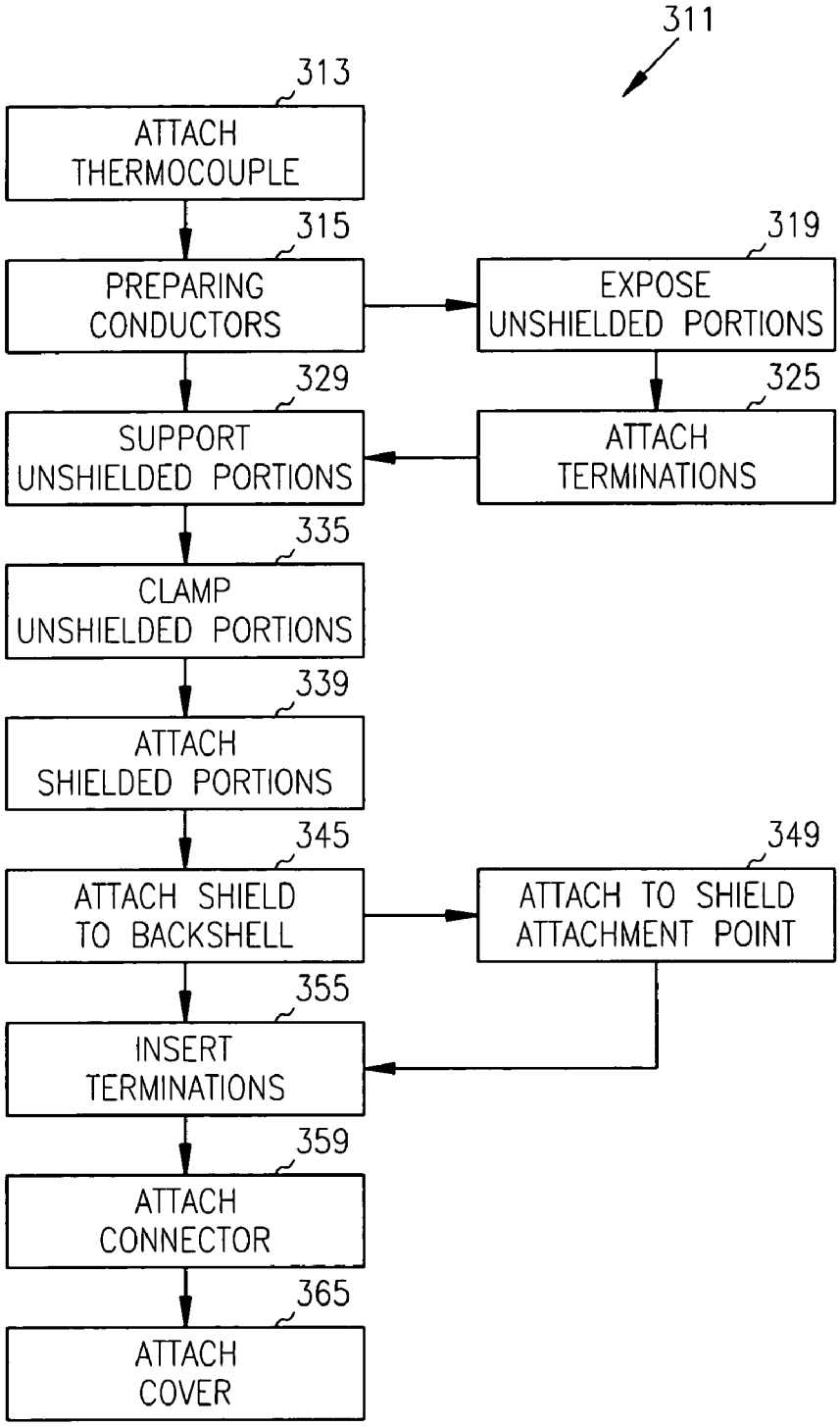
FIG. 3 is an assembly method according to an embodiment of the invention.

FIG. 3 is an assembly method according to an embodiment of the invention. The method 311, which can be a method of assembling a connector housing or a connector assembly, can include attaching a temperature sensing device, such as a thermocouple to a thermocouple attachment point located on a backshell surface, such as an interior surface of a backshell, at block 313. The method continues with preparing a plurality of conductors (e.g., the conductors in a cable) for termination at block 315, which may include exposing one or more unshielded portions of some or all of the plurality of conductors at block 319 and attaching terminations, including sockets, pins, or connector inserts, to one or more of the conductors (i.e., shielded and/or unshielded) at block 325.

The method 311 can then continue at block 329 with laying a plurality of the unshielded conductor portions (typically included in a plurality of shielded conductors) against a backshell support, which may be curved, substantially flat, or otherwise. The backshell, as noted above, can have a thermocouple attachment point which is in thermal communication with an interior or exterior surface of the backshell.

The method 311 includes clamping the unshielded conductor portions against the backshell support at block 335, attaching the shielded portions included in the plurality of shielded conductors to a shield conductor at block 339, and attaching the shield conductor to the backshell at block 345. Attaching the shield conductor to the backshell at block 345 can include attaching the shield conductor to a shield attachment point, which may be located on the backshell or on a clamp, at block 349.

The method 311 includes inserting the terminated conductors into a connector insert at bock 355, if necessary, and attaching the connector to the backshell at block 359. The method 311 concludes with attaching a cover to the backshell at block 365. The cover can include a periphery, as noted previously, and the periphery can be located or proximately disposed in abutting relationship with a lip included in the backshell.

CONCLUSION

An apparatus and method for terminating conductors have been disclosed. The apparatus and method provide a mechanism for efficient termination of conductors, as well as their repair. A removable cover gives ready access to conductor connections without the necessity of disturbing shield connections. Thermocouple attachment options allow users of the apparatus to monitor temperature conditions within the backshell, as well as in the surrounding (ambient) environment.

Although specific embodiments have been illustrated and described herein, it should be appreciated that any arrangement calculated to achieve the same purpose may be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description.

The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract of the Disclosure is provided to comply with 37 C.F.R. § 1.72(b) requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

What is claimed is:

1. An apparatus, comprising:

a backshell having a conductor receiving support surface, the conductor receiving support surface being elevated above an interior surface of the backshell, and wherein the conductor receiving support surface is substantially flat;

a substantially flat clamp capable of attaching a plurality of unshielded conductor portions to the conductor receiving support surface;

wherein the clamp is positioned substantially parallel to the conductor receiving support surface in order to secure the unshielded conductor portions therebetween; and a thermocouple attachment point in thermal communication with the interior surface of the backshell, elevated above the interior surface, and positioned below the conductor receiving support surface.

2. The apparatus of claim 1, wherein a plane including the thermocouple attachment point is substantially parallel to and elevated above a plane including a substantially flat interior surface of the backshell.

3. The apparatus of claim 1, wherein the clamp is substantially conformable to a shape of the conductor receiving support surface.

4. The apparatus of claim 1, wherein the backshell includes a lip.

5. The apparatus of claim 4, further comprising:

a cover capable of removable attachment to the backshell, wherein the cover has a periphery abutting the lip when the cover is attached to the backshell.

6. An apparatus, comprising:

a backshell having a substantially flat support and a lip;

a cover including a periphery located in abutting relationship and substantially flush with the lip;

a substantially flat clamp capable of attaching a plurality of unshielded conductor portions to the substantially flat support; and a connector insert removably attached to the backshell a shield attachment point in electrical communication with an exterior of the backshell; and a thermocouple attachment point in thermal communication with an interior surface of the backshell.

7. The apparatus of claim 6, wherein the connector insert is a D-shaped connector insert having fifty conductive paths therethrough.

8. The apparatus of claim 6, wherein the shield attachment point is located on the clamp.

9. The apparatus of claim 6, wherein the shield attachment point is capable of being placed in electrical communication with at least one shielded portion of a conductor including one of the plurality of unshielded conductor portions.

10. The apparatus of claim 9, wherein the thermocouple attachment point is included in a recess of the backshell.

11. The apparatus of claim 6, further comprising:

a temperature sensing device attached to the thermocouple attachment point.

12. A method, comprising:

laying a plurality of unshielded conductor portions included in a plurality of shielded conductors against a substantially flat support of a backshell;

attaching the plurality of unshielded conductor portions to the substantially flat support of the backshell;

attaching a plurality of shielded portions included in the plurality of shielded conductors to an external shield conductor;

attaching the shield conductor to an exterior of the backshell; and attaching a temperature sensing device to a thermocouple attachment point in thermal communication with an interior surface of the backshell.

13. The method of claim 12, further comprising:

attaching a cover to the backshell, wherein the cover includes a periphery and the periphery is in abutting relationship with a lip of the backshell.

14. The method of claim 12, further comprising:

attaching a plurality of connector terminations to a corresponding plurality of conductors included in a plurality of shielded conductors.

15. The method of claim 12, wherein attaching the shield conductor to the backshell comprises:

attaching the shield conductor to a shield attachment point.

16. The method of claim 15, wherein the shield attachment point is located on a clamp.

* * * * *